US009746256B2

(12) United States Patent
Esformes et al.

(10) Patent No.: US 9,746,256 B2
(45) Date of Patent: Aug. 29, 2017

(54) SHELL AND TUBE HEAT EXCHANGER WITH A VAPOR PORT

(71) Applicant: Carrier Corporation, Farmington, CT (US)

(72) Inventors: Jack Leon Esformes, Jamesville, NY (US); XingHua Huang, Shanghai (CN); Marcel Christians, Skaneateles, NY (US); Satyam Bendapudi, Manlius, NY (US); Sean P. Breen, Holyoke, MA (US); Salim Bahattin Yilmaz, West Hills, CA (US)

(73) Assignee: CARRIER CORPORATION, Farmington, CT (US)

( * ) Notice: Subject to any disclaimer, the term of this patent is extended or adjusted under 35 U.S.C. 154(b) by 489 days.

(21) Appl. No.: 14/349,138

(22) PCT Filed: Nov. 15, 2012

(86) PCT No.: PCT/US2012/065218
§ 371 (c)(1),
(2) Date: Apr. 2, 2014

(87) PCT Pub. No.: WO2013/074749
PCT Pub. Date: May 23, 2013

(65) Prior Publication Data

US 2014/0311721 A1 Oct. 23, 2014

Related U.S. Application Data

(60) Provisional application No. 61/561,507, filed on Nov. 18, 2011.

(51) Int. Cl.
*F28D 7/00* (2006.01)
*F28F 9/02* (2006.01)
(Continued)

(52) U.S. Cl.
CPC ..... *F28F 9/0273* (2013.01); *F25B 39/028* (2013.01); *F28D 3/02* (2013.01);
(Continued)

(58) Field of Classification Search
CPC . F28F 9/0273; F28F 2009/224; F25B 39/028; F25B 39/02; F25B 2339/0242;
(Continued)

(56) References Cited

U.S. PATENT DOCUMENTS 4,246,872 A 1/1981 Skinner et al.
5,240,070 A 8/1993 Ryan
(Continued)

FOREIGN PATENT DOCUMENTS

EP 0752567 A1 1/1997
FR 2096853 A1 3/1972
(Continued)

OTHER PUBLICATIONS

Chinese Office Action for CN Application No. 201280056556.1, dated Aug. 6, 2015, pp. 1-20.
(Continued)

*Primary Examiner* — Len Tran
*Assistant Examiner* — Claire Rojohn, III
(74) *Attorney, Agent, or Firm* — Cantor Colburn LLP

(57) ABSTRACT

A shell and tube heat exchanger having a shell having an inner surface that defines a heat exchange zone, a refrigerant pool zone is arranged in the heat exchange zone, and a plurality of tube bundles are arranged in the heat exchange zone above the refrigerant pool zone. The tube bundles have first and second wall members that define a tube channel, and a plurality of tubes arranged in the tube channel. Each of the first and second wall members have a first end that extends to a second end that is spaced from the refrigerant pool zone. The plurality of tube bundles is spaced one from
(Continued)

another so as to define one or more vapor passages. A refrigerant distributor is positioned above the tube channel. The refrigerant distributor delivers a refrigerant onto the plurality or tubes toward the refrigerant pool zone.

13 Claims, 3 Drawing Sheets

(51) Int. Cl.

| | |
|---|---|
| ***F28D 3/02*** | (2006.01) |
| ***F28D 3/04*** | (2006.01) |
| ***F28D 7/16*** | (2006.01) |
| ***F25B 39/02*** | (2006.01) |
| *F28D 21/00* | (2006.01) |
| *F28F 9/22* | (2006.01) |

(52) U.S. Cl.
CPC ..... *F28D 3/04* (2013.01); *F28D 7/163* (2013.01); *F28D 21/0017* (2013.01); *F25B 2339/0242* (2013.01); *F28D 2021/0071* (2013.01); *F28F 2009/224* (2013.01)

(58) Field of Classification Search
CPC ..... F25B 2400/23; F28D 3/02; F28D 7/163; F28D 3/04; F28D 21/0017; F28D 2021/0071
USPC ..... 165/159, 164, 185
See application file for complete search history.

(56) References Cited

U.S. PATENT DOCUMENTS

| | | | | |
|---|---|---|---|---|
| 5,481,887 | A * | 1/1996 | Terasaki | F04D 29/063 62/471 |
| 5,638,691 | A | 6/1997 | Hartfield et al. | |
| 5,645,124 | A | 7/1997 | Hartfield et al. | |
| 5,839,294 | A | 11/1998 | Chiang et al. | |
| 6,035,651 | A | 3/2000 | Carey | |
| 6,167,713 | B1 | 1/2001 | Hartfield et al. | |
| 6,233,967 | B1 | 5/2001 | Seewald et al. | |
| 6,293,112 | B1 | 9/2001 | Moeykens et al. | |
| 6,516,627 | B2 * | 2/2003 | Ring | F25B 31/004 62/193 |
| 6,868,695 | B1 * | 3/2005 | Dingel | F25B 39/028 165/115 |
| 6,892,522 | B2 | 5/2005 | Brasz et al. | |
| 6,962,056 | B2 | 11/2005 | Brasz et al. | |
| 7,228,711 | B2 | 6/2007 | Taras et al. | |
| 7,849,710 | B2 * | 12/2010 | De Larminat | F25B 39/028 62/515 |
| 8,302,426 | B2 * | 11/2012 | de Larminat | F25B 39/028 62/515 |
| 8,650,905 | B2 * | 2/2014 | De Larminat | F25B 39/028 62/515 |
| 2004/0256088 | A1 * | 12/2004 | Ayub | F25B 39/02 165/132 |
| 2008/0148767 | A1 | 6/2008 | De Larminat et al. | |
| 2008/0149311 | A1 * | 6/2008 | Liu | F25B 39/028 165/115 |
| 2008/0190591 | A1 * | 8/2008 | Ayub | F25B 39/02 165/158 |
| 2008/0196839 | A1 | 8/2008 | Porscha et al. | |
| 2009/0178790 | A1 | 7/2009 | Schreiber et al. | |
| 2010/0242533 | A1 * | 9/2010 | De Larminat | F25B 39/028 62/498 |
| 2010/0326108 | A1 | 12/2010 | Schreiber et al. | |
| 2011/0017432 | A1 | 1/2011 | Kulankara et al. | |
| 2011/0023515 | A1 | 2/2011 | Kopko et al. | |

FOREIGN PATENT DOCUMENTS

| | | | |
|---|---|---|---|
| GB | 2095389 | A | 9/1982 |
| JP | 2007309604 | A | 11/2007 |
| WO | 2009089488 | A1 | 7/2009 |
| WO | 2013074749 | A1 | 5/2013 |

OTHER PUBLICATIONS

International Search Report and Written Opinion for PCT Application No. PCT/US2012/065218, dated Mar. 25, 2013, pp. 1-11.

* cited by examiner

SHELL AND TUBE HEAT EXCHANGER WITH A VAPOR PORT

CROSS-REFERENCE TO RELATED APPLICATIONS

This application is a National Stage of PCT Application No. PCT/US12/65218 filed Nov. 15, 2012, which claims the benefit of priority of U.S. Provisional Application No. 61/561,507 filed Nov. 18, 2011, the disclosure of which is incorporated by reference herein in its entirety.

BACKGROUND OF THE INVENTION

Exemplary embodiments pertain to the art of heat exchangers and, more particularly, to a shell and tube heat exchanger.

Many refrigeration systems include an evaporator to facilitate heat transfer between a refrigerant and another fluid. A typical evaporator includes a shell with a plurality of tubes forming a tube bundle through which a fluid to be cooled is circulated. The refrigerant is brought into a heat exchange relationship with the tube bundle inside the shell resulting in a thermal energy transfer with the fluid to be cooled. After passing from the evaporator, the refrigerant returns to a vapor state, is passed to a compressor to be compressed to a vapor at an elevated pressure and condensed into a liquid in a second heat exchanger. The liquid is then expanded to a reduced pressure through an expansion device and then back to the evaporator to begin another refrigerant cycle. The cooled fluid is circulated to a plurality of additional heat exchangers to effect cooling of various spaces. Warmer air from each space is passed over the additional heat exchangers and cooled. The now cooler air is then returned to the respective space to achieve a desired environmental conditioning.

BRIEF DESCRIPTION OF THE INVENTION

Disclosed is a shell and tube heat exchanger including a shell having an outer surface and an inner surface that defines a heat exchange zone, a refrigerant pool zone arranged in the heat exchange zone, and a plurality of tube bundles arranged in the heat exchange zone above the refrigerant pool zone. Each of the plurality of the tube bundles includes first and second wall members that define a tube channel, and a plurality of tubes arranged in the tube channel. Each of the first and second wall members have a first end that extends to a second end that is spaced from the refrigerant pool zone. The plurality of tube bundles is spaced one from another so as to define one or more vapor passages. A refrigerant distributor is positioned above the tube channel. The refrigerant distributor is configured and disposed to deliver a refrigerant onto the plurality of tubes toward the refrigerant pool zone.

Also disclosed is a method of operating a shell and tube heat exchanger. The method includes guiding a liquid refrigerant toward a plurality of tube bundles each having first and second wall members that define a tube channel. The plurality of tube bundles are spaced one from another to define one or more vapor passages. A liquid refrigerant is passed onto a refrigerant distributor arranged above the tube channel. The liquid refrigerant is distributed from the refrigerant distributor onto a plurality of tubes extending through the tube channel and the liquid refrigerant is allowed to fall under force of gravity over the plurality of tubes extending through the tube channel. The method further includes exchanging heat energy between the refrigerant and a fluid passing through the plurality of tubes, collecting the liquid refrigerant in a refrigerant pool zone arranged below the tube bundle, and guiding refrigerant vapor through the vapor passages defined between the plurality of tube bundles.

Further disclosed is a shell and tube heat exchanger including a shell having an outer surface and an inner surface that defines a heat exchange zone, a low pressure refrigerant pool zone arranged in the heat exchange zone, and a tube bundle is arranged in the heat exchange zone above the low pressure refrigerant pool zone. The tube bundle includes first and second wall members that define a tube channel, and a plurality of tubes arranged in the tube channel. Each the first and second wall members have a first end that extends to a second end that is spaced from the low pressure refrigerant pool zone. A low pressure refrigerant distributor is positioned above the tube channel. The low pressure refrigerant distributor is configured and disposed to deliver a low pressure refrigerant onto the plurality or tubes toward the low pressure refrigerant pool zone.

BRIEF DESCRIPTION OF THE DRAWINGS

The following descriptions should not be considered limiting in any way. With reference to the accompanying drawings, like elements are numbered alike.

DETAILED DESCRIPTION OF THE INVENTION

A detailed description of one or more embodiments of the disclosed apparatus and method are presented herein by way of exemplification and not limitation with reference to the Figures.

Figure 1:
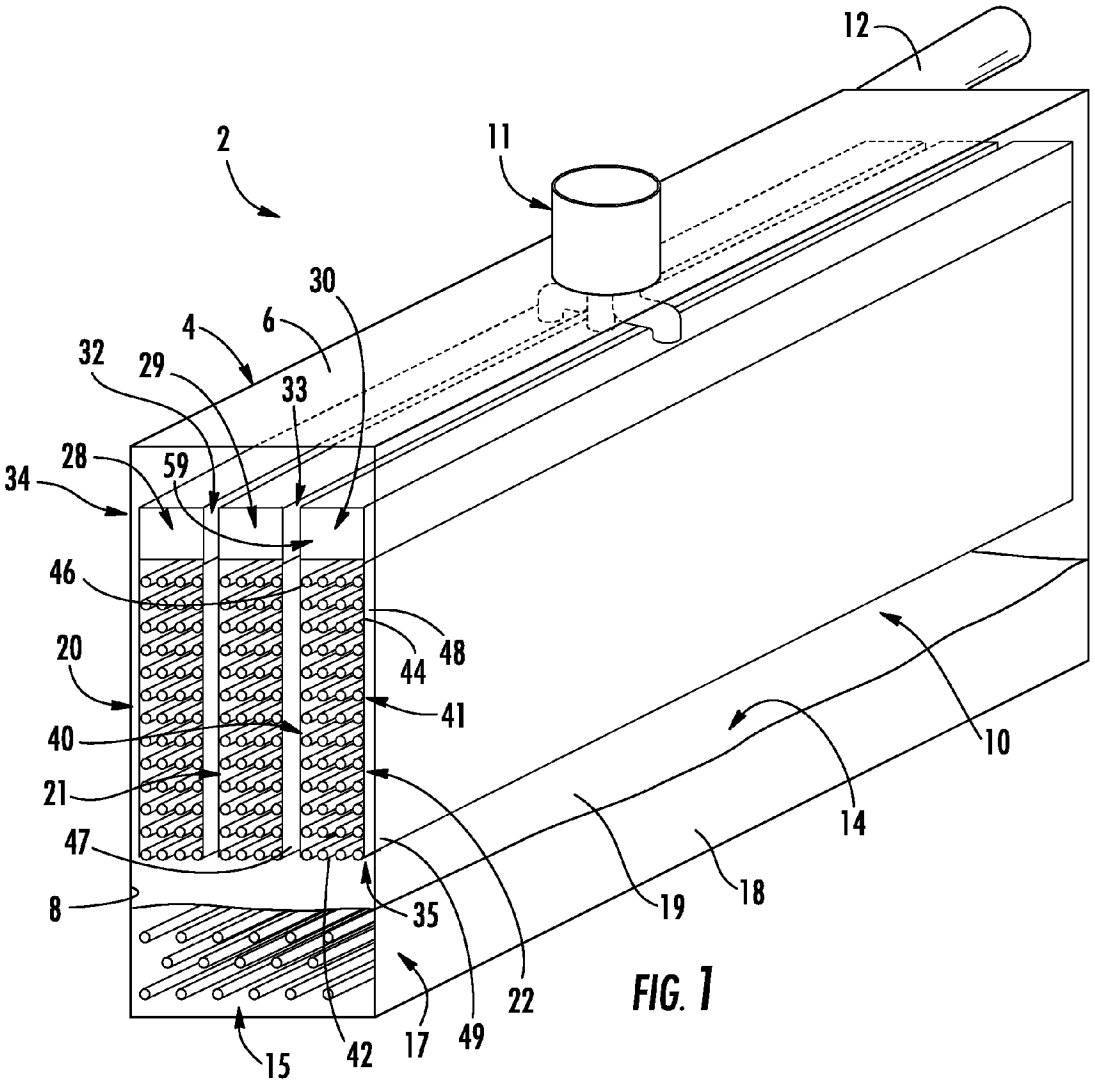
FIG. 1 is a partial perspective view of a shell and tube evaporator employing a low pressure refrigerant in accordance with an exemplary embodiment.

With reference to FIG. 1, a shell and tube evaporator employing low pressure refrigerant in accordance with an exemplary embodiment is indicated generally at 2. Shell and tube evaporator 2 includes a shell 4 having an outer surface 6 and an inner surface 8 that define a heat exchange zone 10. In the exemplary embodiment shown, shell 4 includes a non-circular cross-section. As shown, shell 4 includes a rectangular cross-section however, it should be understood that shell 4 can take on a variety of forms including both circular and non-circular. Shell 4 includes a refrigerant inlet 11 that is configured to receive a source of low pressure refrigerant (not shown). Shell 4 also includes a vapor outlet 12 that is configured to connect to an external device such as a compressor. Shell and tube evaporator 2 is also shown to include a low pressure refrigerant pool zone 14 arranged in a lower portion of shell 4. Low pressure refrigerant pool zone 14 includes a pool tube bundle 15 that circulates a fluid through a pool of low pressure refrigerant 17. Pool of low pressure refrigerant 17 includes an amount of liquid low pressure refrigerant 18 having an upper surface 19. The fluid circulating through the pool tube bundle exchanges heat with pool of low pressure refrigerant 17 to convert the amount of low pressure refrigerant 18 from a liquid to a vapor state. At this point it should be understood that the term "low pressure refrigerant" defines a refrigerant having a liquid phase saturation pressure below about 45 psi (310.3 kPa) at 104° F. (40° C.). An example of low pressure refrigerant includes R245fa. It should also be understood that while described as employing a low pressure refrigerant, the exemplary embodiments could also employ a medium pressure refrigerant. The term "medium pressure refrigerant" defines a refrigerant having a liquid phase saturation pressure between 45 psia (310.3 kPa) and 170 psia (1172 kPa) at 104° F. (40° C.).

In accordance with the exemplary embodiment shown, shell and tube evaporator 2 includes a plurality of tube bundles 20-22 that provide a heat exchange interface between low pressure refrigerant and another fluid. At this point it should be understood that while shown with a plurality of tube bundles 20-22, a single tube bundle could also be employed in connection with shell and tube evaporator 2. Each tube bundle 20-22 includes a corresponding low pressure refrigerant distributor 28-30. Low pressure refrigerant distributors 28-30 provide a uniform distribution of refrigerant onto tube bundles 20-22 respectively. As will become more fully evident below, low pressure refrigerant distributors 28-30 deliver a low pressure refrigerant onto the corresponding ones of tube bundles 20-22. Tube bundles 20-22 are spaced one from another to form first and second vapor passages 32 and 33. In addition, tube bundles 20 and 22 are spaced from inner surface 8 to establish first and second outer vapor passages 34 and 35. As each tube bundle 20-22 and associated low pressure refrigerant distributor 28-30 is substantially similarly formed, a detailed description will follow with reference to tube bundle 22 and low pressure refrigerant distributor 30 with an understanding the tube bundles 20 and 21 and low pressure refrigerant distributors 27 and 28 are similarly constructed.

In further accordance with the exemplary embodiment shown, tube bundle 22 includes first and second wall members 40 and 41. First and second wall members 40 and 41 are spaced one from another to define a tube channel 42 through which pass a plurality of tubes 44 that are configured to carry a liquid. As will become more fully evident below, liquid passing through the plurality of tubes 44 is in a heat exchange relationship with the low pressure refrigerant flowing into tube channel 41. First wall member 40 includes a first end 46 that extends to a second end 47. Similarly, second wall member 41 includes a first end 48 that extends to a second end 49. Each first end 46 and 48 is spaced below low pressure refrigerant distributor 30 while each second end 47 and 49 is spaced above low pressure refrigerant pool 17. With this arrangement, liquid low pressure refrigerant flowing from low pressure refrigerant distributor 30 flows, under force of gravity, through tube channel 42, over tubes 44 and passes into low pressure refrigerant pool 17. In this manner, the refrigerant reduces a temperature of liquid flowing through tubes 44 before transitioning to a vapor for return to, for example, a compressor (not shown).

Figure 2:
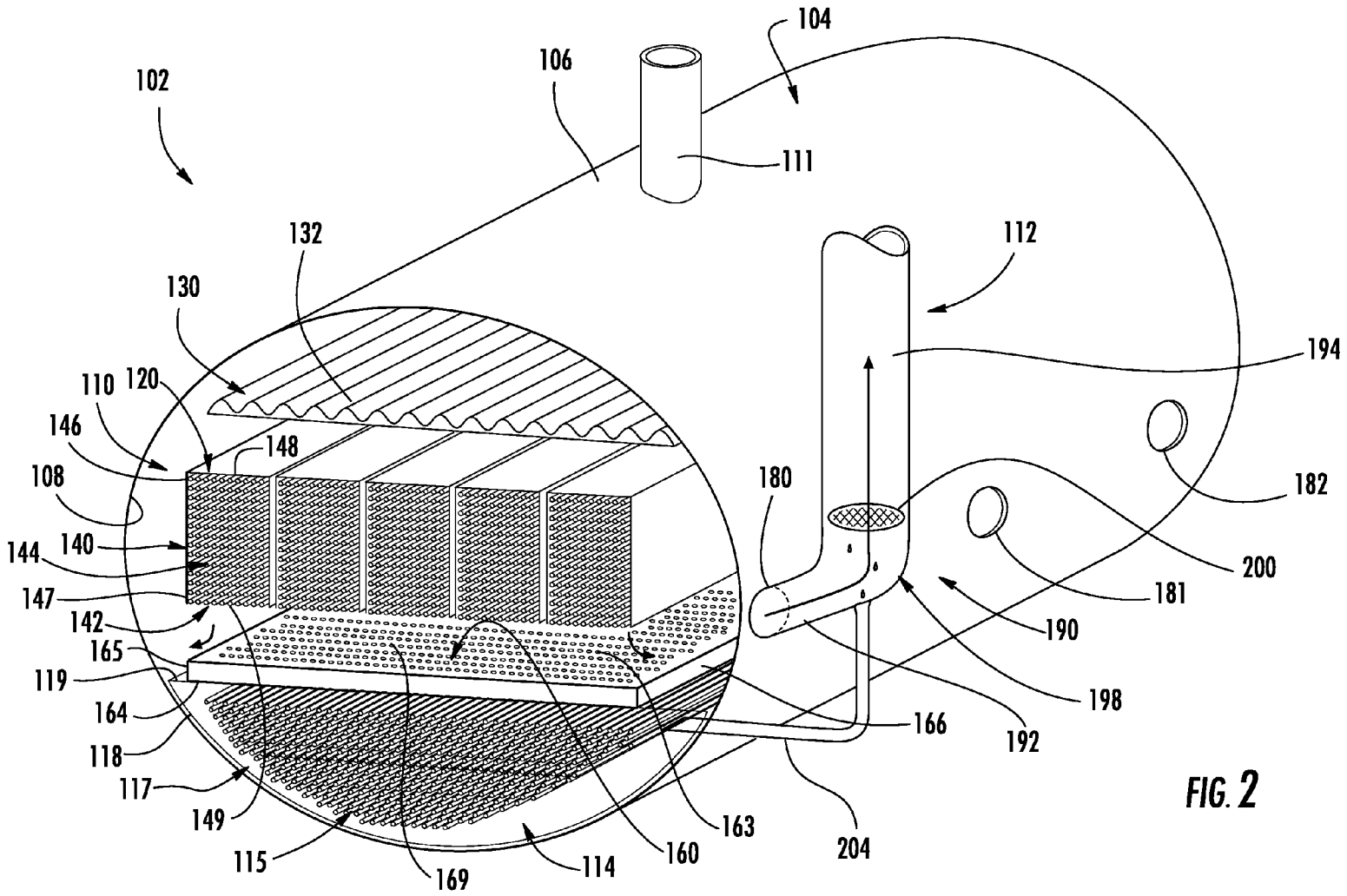
FIG. 2 is a perspective view a shell and tube evaporator employing a low pressure refrigerant in accordance with another aspect of the exemplary embodiment.
Figure 3:
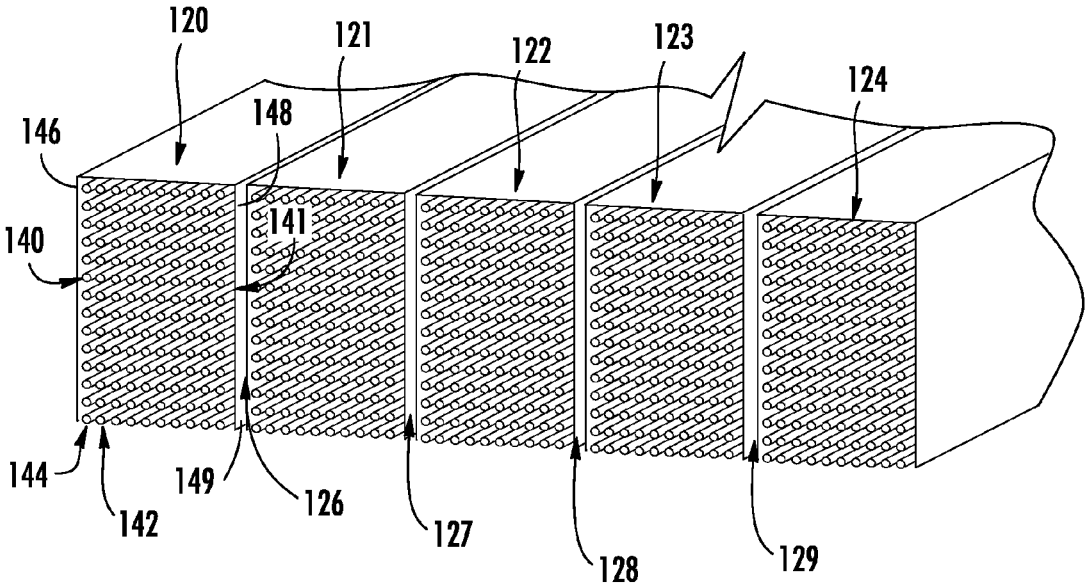
FIG. 3 is a detail view of the shell and tube heat exchanger of FIG. 2.

Reference will now be made to FIGS. 2 and 3 in describing a shell and tube evaporator 102 that employs low pressure refrigerant to lower a temperature of a secondary medium. Shell and tube evaporator 102 includes a shell 104 having an outer surface 106 and an inner surface 108 that define a heat exchange zone 110. In the exemplary embodiment shown, shell 104 includes a non-circular cross-section however, it should be understood that shell 104 take on a variety of forms including both circular and non-circular. More specifically, shell 104 includes a generally oval cross-section. Shell 104 includes a refrigerant inlet 111 that is configured to receive a source of low pressure refrigerant (not shown). Shell 104 also includes a vapor outlet 112 that is configured to connect to an external device such as a compressor. Shell and tube evaporator 102 is also shown to include a low pressure refrigerant pool zone 114 arranged in a lower portion of shell 104. Low pressure refrigerant pool zone 114 includes a pool tube bundle 115 that circulates a fluid through a pool of low pressure refrigerant 117 including an amount of liquid low pressure refrigerant 118 having an upper surface 119. In a manner similar to that discussed above, the fluid circulating through the pool tube bundle 115 exchanges heat with pool of low pressure refrigerant 117 to convert the amount of low pressure refrigerant 118 from a liquid to a vapor state.

Shell and tube evaporator 102 includes a plurality of tube bundles 120-124 that provide a heat exchange interface between the low pressure refrigerant and another fluid. Tube bundles 120-124 are spaced one from another to form a plurality of vapor passages 126-129. In addition, tube bundle 120 and 124 are spaced from inner surface 108 to establish outer vapor passages (not separately labeled) In accordance with the exemplary aspect shown, a low pressure refrigerant distributor 130, that takes the form of a trough 132, extends above tube bundle 110. As will become more fully evident below, low pressure refrigerant distributor 130 delivers the low pressure refrigerant onto tube bundle 110.

As each tube bundle 120-124 is similarly formed, a detailed description will follow with reference to tube bundle 120 with an understanding that tube bundles 121-124 include corresponding structure. As shown tube bundle 120 includes first and second wall members 140 and 141. First and second wall members 140 and 141 are spaced one from another to define a tube channel 142 through which pass a plurality of tubes 144 that are configured to carry a liquid. As will become more fully evident below, liquid passing through the plurality of tubes 144 is in a heat exchange relationship with the low pressure refrigerant flowing into tube channel 141. First wall member 140 includes a first end 146 that extends to a second end 147. Similarly, second wall member 141 includes a first end 148 that extends to a second end 149. Each first end 146 and 148 is spaced below low pressure refrigerant distributor 130 while each second end 147 and 149 is spaced above a separator plate 160 that extends over surface 119.

With this arrangement, liquid low pressure refrigerant flows across low pressure refrigerant distributor 130 and through openings (not shown) formed therein. The liquid low pressure refrigerant flows, under force of gravity, through tube channel 142, over tubes 144 and passes onto separator plate 160. Separator plate 160 includes a first surface 163, an opposing second surface 164, a first longitudinal edge 165 and a second longitudinal edge 166. A plurality of passages extends through first and second opposing surfaces 163 and 164. Liquid low pressure refrigerant passes from tube bundles 120-124 onto first surface 163 and passes through passages 169 into low pressure refrigerant pool 117. Vapor from passes from low pressure refrigerant pool 117 around edges 165 and 166 into an upper region of shell 104. In this manner, low pressure refrigerant in vapor form rising through shell 104 does not interfere with liquid low pressure refrigerant falling though tube bundles 120-124.

In further accordance with the exemplary aspect shown, shell and tube evaporator 102 includes a plurality of vapor ports 180-182 that guide low pressure refrigerant in vapor form back to for example, a compressor (not shown). Vapor ports 180-182 are provided with mist or liquid eliminators, one of which is shown at 190, which separate liquid low pressure refrigerant from the low pressure refrigerant in vapor form. Liquid eliminator 190 includes an inlet section 192 having a first diameter and an outlet section 194 having a second diameter joined by a 90° elbow 198. The different diameters lower a momentum of the low pressure refrigerant vapor passing through liquid eliminator 190 to facilitate liquid separation. A liquid eliminator screen 200 is positioned in outlet section 194 above elbow 198. Liquid eliminator screen 200 traps liquid low pressure refrigerant passing through liquid eliminator 190. The liquid low pressure refrigerant passes to a drain line 204 that is fluidly connected to low pressure refrigerant pool 117. Low pressure refrigerant in vapor form exits through outlet section 194 and merges with low pressure refrigerant vapor from other ones of vapor ports 181 and/or 182 before passing to, for example, a compressor (not shown).

At this point it should be understood that the example embodiments describe a shell and tube evaporator that employs a low pressure refrigerant to facilitate heat exchange with a secondary medium. The use of falling film systems and low pressure refrigerant provides various advantages over prior art systems. For example, the use of falling film systems employing low pressure refrigerant reduces pressure losses associated with flow through the tube bundles as compared to conventional flooded evaporator bundles of similar size. In addition, falling film systems employ a lower refrigerant charge, thereby leading to an overall cost reduction. Additional benefits are realized by higher heat transfer coefficients associated with using falling film evaporation in a low pressure refrigerant. It should be also understood, that while shown as having a circular cross-section, the tube bundles can be formed from tubes having non-circular cross-sections and/or tubes formed of assembles of brazed channels. Finally, as discussed above, the exemplary embodiments could also employ medium pressure refrigerants.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims.

What is claimed is:

1. A shell and tube heat exchanger comprising:

a shell having an outer surface and an inner surface that defines a heat exchange zone;

a refrigerant pool zone arranged in the heat exchange zone;

a pool tube bundle of tubes located in the refrigerant pool zone;

a plurality of tube bundles arranged in the heat exchange zone above the refrigerant pool zone, each of the plurality of the tube bundles including first and second wall members that define a tube channel, and a plurality of tubes arranged in the tube channel, each of the first and second wall members having a first end that extends to a second end that is spaced from the refrigerant pool zone, the plurality of tube bundles being spaced one from another so as to define one or more vapor passages; and a single refrigerant distributor positioned above the tube channel, the refrigerant distributor being configured and disposed to deliver a refrigerant onto the plurality of tubes toward the refrigerant pool zone;

wherein the single refrigerant distributor includes an inlet, an outlet, and at least one distribution plate, the refrigerant flowing through the refrigerant distributor by force of gravity;

wherein the single refrigerant distributor provides refrigerant to all the plurality of tube bundles.

2. The shell and tube heat exchanger according to claim 1, wherein the plurality of tube bundles are spaced from the inner surface of the shell so as to define first and second outer vapor channels.

3. The shell and tube heat exchanger according to claim 1, further comprising: an amount of refrigerant arranged in the refrigerant pool zone, the amount of refrigerant having a refrigerant free surface that is spaced from the second end of each of the first and second wall members.

4. The shell and tube heat exchanger according to claim 3, wherein the amount of refrigerant comprises an amount of low pressure refrigerant having a liquid phase saturation pressure below about 45 psi (310.3 kPa) at 104 ° F. (40 ° C.).

5. The shell and tube heat exchanger according to claim 1, further comprising: a separator plate arranged in the heat exchange zone between the refrigerant pool zone and the second ends of each of the wall members.

6. The shell and tube heat exchanger according to claim 5, wherein the separator plate includes a plurality of passages that are configured to guide liquid refrigerant from the tube bundle toward the refrigerant pool zone.

7. The shell and tube heat exchanger according to claim 1, further comprising: a vapor port formed in the shell above the refrigerant pool zone.

8. The shell and tube heat exchanger according to claim 7, wherein the vapor port outlets to a liquid eliminator configured and disposed to separate liquid refrigerant from vapor refrigerant.

9. The shell and tube heat exchanger according to claim 8, wherein the liquid eliminator includes a liquid refrigerant drain configured to guide liquid refrigerant to the refrigerant pool zone.

10. The shell and tube heat exchanger according to claim 9, wherein the liquid refrigerant drain is fluidly connected to the first section and the dehumidifier is arranged in the second section.

11. The shell and tube heat exchanger according to claim 9, wherein the liquid eliminator includes a first section that extends to a second section, the second section being perpendicular to the first section.

12. The shell and tube heat exchanger according to claim 11, wherein the first section has a first diameter and the second section includes a second diameter, the first diameter being distinct from the second diameter.

13. The shell and tube heat exchanger according to claim 12, wherein the liquid refrigerant drain has a first end connected to the first section having the first diameter and second end fluidly connected to the refrigerant pool zone.

* * * * *